US005290042A

United States Patent [19]

Worley et al.

[11] Patent Number: 5,290,042

[45] Date of Patent: Mar. 1, 1994

[54] ARCHERY TARGET AND A METHOD OF MAKING AN ARCHERY TARGET

[76] Inventors: Kirk C. Worley, 1134 W. Anderson, Linwood, Mich. 48634; Kris R. Worley, 10470 Busch Rd., Birch Run, Mich. 48415

[21] Appl. No.: 974,483

[22] Filed: Nov. 12, 1992

[51] Int. Cl.[5] ..... F41J 1/00

[52] U.S. Cl. ..... 273/408

[58] Field of Search ..... 273/408, 403, 404, 407

[56] References Cited

U.S. PATENT DOCUMENTS

| | | | |
|---|---|---|---|
| 275,111 | 4/1883 | Alday | 273/408 |
| 1,818,939 | 8/1931 | Brading | 273/403 |
| 2,990,179 | 6/1961 | Barna | 273/408 |
| 3,088,738 | 5/1963 | Meyer | 273/407 X |
| 3,163,418 | 12/1964 | Myers | 273/408 |
| 3,164,384 | 1/1965 | Stewart | 273/403 |
| 3,203,698 | 8/1965 | Saunders | 273/404 |
| 3,329,431 | 7/1967 | Roesner | 273/403 |
| 3,367,660 | 2/1968 | Di Maggio | 273/404 |
| 4,126,501 | 11/1978 | Croll | 273/408 X |
| 4,189,146 | 2/1980 | Warner | 273/408 |
| 4,244,585 | 1/1981 | Croll | 273/408 |
| 4,425,268 | 1/1984 | Cooper | 524/110 |
| 4,430,789 | 2/1984 | Wu | 273/408 X |
| 4,491,328 | 1/1985 | Meyer | 273/403 |
| 4,504,434 | 3/1985 | Cooper | 264/22 |
| 4,695,060 | 9/1987 | Pilgrim | 273/404 |
| 5,002,285 | 3/1991 | Morrell | 273/408 |

*Primary Examiner*—William H. Grieb

*Attorney, Agent, or Firm*—Learman & McCulloch

[57] ABSTRACT

The archery target (12) includes a rectangular core of compressed wheat straw (80) or similar organic material, multiple wraps of self-adhesive stretch film covering the large sides C, the small sides B, and the ends A. The compressed bale of wheat straw (80) wrapped with multiple layers of self-adhesive stretch film (64) on all surfaces is covered by a burlap bag (86), the open ends of the bag (86) are closed and target indicia (102) are affixed to surfaces of the burlap bag (86) that cover the two large sides C of the bale (80). The archery target (12) is produced by compressing a bale of wheat straw (80) to reduce its length and to provide the desired density to control arrow penetration. Retainer bands (84) are placed around the bale (80). The large sides C and the small sides B are wrapped with multiple layers of self-adhesive stretch film (64). The ends A and the large sides C are then wrapped with multiple layers of film (64). The ends A and the small sides B are wrapped with multiple layers of film 64 after wrapping of the other surfaces is completed. The compressed and wrapped bale (80) is inserted into a burlap bag (86), the bag is closed, and target indicia applied to the surfaces of the bag (86) that covers the two large sides C of the bale (80).

17 Claims, 2 Drawing Sheets

ARCHERY TARGET AND A METHOD OF MAKING AN ARCHERY TARGET

TECHNICAL FIELD

The invention is in an archery target and a method of making an archery target and, more specifically, in an archery target with controlled arrow penetration and long life.

BACKGROUND OF THE INVENTION

Archery targets are to stop arrows and hold arrows in the same attitude in which they strike the target. To be practical, targets which stop and hold arrows must be relatively inexpensive to manufacture and must have a relatively long, useful life. Archery targets are to stop arrows so that an archer can determine the point of impact, to make arrow retrieval relatively easy and quick, and to prevent arrows from striking objects that arrows could injure or damage. An arrow which strikes a target should be reusable and free of damage, and should be held in the same attitude in which it struck the target. Arrows are expensive and must be protected by a target. Arrows which are held in the same attitude in which they strike a target are generally not damaged by other arrows. Arrows which are held at the tip only and fall to a position with the shaft lying along the face of a target are frequently damaged or destroyed by other arrows.

Archery bows are available today which are capable of transferring high energy to arrows. There are also arrows with shafts made from composite materials that increase penetration capability. Targets should be able to stop and hold arrows with composite material shafts that strike targets with high energy that has been supplied by a special bow.

Archery targets are available that are made from a foam material. Foam material is damaged significantly each time it is penetrated by an arrow. Such targets develop holes after being struck a few times in one area that will allow the passage of an arrow. An arrow which passes through such a hole may be deflected in a different direction resulting in lost arrows, damage to arrows or property, or even injury. Foam material targets have limited energy absorption capability. Arrows with high impact energy or with high penetration capability may pass through a foam material target. High energy and composite material arrows may be stoppable only by increasing target thickness. Although archery targets made from foam material are inexpensive to make, they may be relatively expensive to use due to their relatively short life and the need for increased thickness to stop some arrows.

Archery targets are available with internal barriers that are designed to prevent penetration. The material that prevents penetration is normally in a plane through the center of the target. The face of the target is covered with a material such as straw that is to hold arrows in the attitude they were in when they struck the target face. The internal barrier may be a sheet material made from a special high strength material and employed in combination with a material such as cotton which tends to stick to and ball up on the tip of an arrow. These targets are difficult to manufacture and are difficult to hold together due to the various layers of material. The material on the face Of the target frequently fails to hold arrows up in the position in which they struck the target. The internal barrier material may also fail to stop some arrows. Arrows with tips with special shapes or that are made from materials with special properties may pass through the barrier material.

Archery targets made from straw that is first rolled into a long strand or rope and is then coiled to form a target can have long life, good holding ability, and fair stopping characteristics. The time and effort required to construct such a target is substantial. Due to the time required to construct a good target in this manner, such targets are relatively expensive. Another drawback is that it is difficult to change the arrow stopping characteristics for use with arrows made from materials that provide improved penetration characteristics or arrows that are propelled by high energy bows.

SUMMARY OF THE INVENTION

An object of the invention is to manufacture an inexpensive archery target with superior arrow stopping and holding characteristics and a long, useful life.

Another object of the invention is to provide an archery target with a dense organic core that limits arrow penetration and holds arrows in the position or attitude in which they entered the target, and a wrapper which can be pierced by arrows and still retain the organic material in the core.

A further object of the invention is to provide an archery target with an organic core that is compressed to a density which permits the desired arrow penetration.

The archery target is produced from a standard rectangular agricultural bale of wheat straw or some other similar grass or grain straw. The bale is reduced in length to increase the density. The density controls arrow penetration and can be set to allow the desired penetration for the arrows and the bows that are to be used. The bale is retained in the shortened condition by a pair of plastic bands. The bale is then wrapped on all six surfaces with plural thicknesses of a self-adhesive stretch film. The self-adhesive stretch film is easily penetrated by an arrow, tends to reclose when an arrow is removed and retains the organic material in the bale in a compacted condition. The compacted bale of organic material wrapped with multiple layers of self-adhesive stretch film is inserted into a burlap cover. Target indicia are placed on the burlap. The target indicia can take a number of different forms. Target indicia are preferably placed on the two largest surfaces of the compressed and wrapped bale. Different systems could be used for adding target indicia to the burlap surfaces. One method is to place a stencil against a surface of the burlap and apply paint to burlap exposed through the stencil with a brush or with a spray system.

Other objects and advantages of the invention will become apparent with reference to the accompanying drawings and the accompanying descriptive matter.

DESCRIPTION OF THE PREFERRED EMBODIMENT

Figure 1:
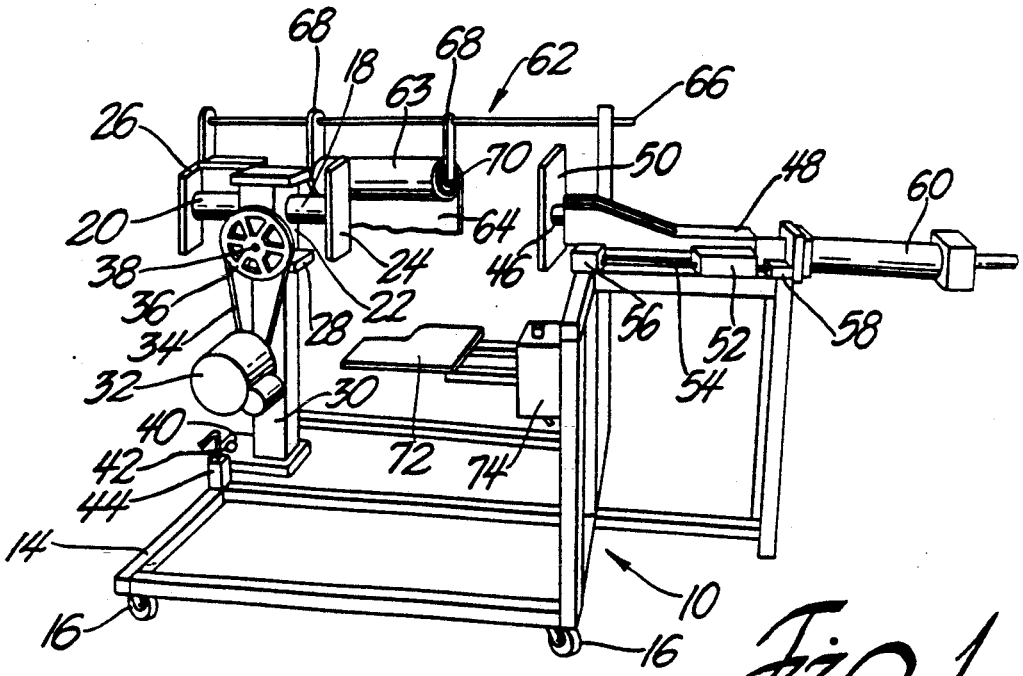
FIG. 1 is a perspective view of a machine for making an archery target.

The machine 10 for making an archery target 12 has a frame 14 supported by four small wheels 16. At least two of the wheels 16 are caster wheels. Driven spindles 18 and 20 extend horizontally from opposite sides of a gear box 22. A flat plate 24 is welded to the free end of spindle 18. A flat plate 26 is welded to the free end of the spindle 20. The gear box 22 is attached to a plate 28 on the top of a pedestal 30. The gear box 20 is driven by an electric motor 32 mounted on the pedestal 30 below the gear case 30. Torque is transmitted from the electric motor 32 to the gear box 22 by a V-belt 34 that is trained around a pulley on the electric motor and a pulley 36 on the gear box input shaft 38. The base of the pedestal 30 is attached to an arm 40 which is journaled on a shaft 42 attached to the frame 14. A lock assembly 44 can lock the pedestal 30 in either of two positions.

A spindle 46 is rotatably mounted on a carriage 48. The spindle 46 is in axial alignment with the driven spindles 18 and 20. A flat plate 50 is welded to the free end of the spindle 46 and faces toward the flat plate 24 or the flat plate 26. The carriage 48 includes a carriage guide block 52 that is slideably mounted on a pair of parallel spaced apart guide rods 54. The guide rods 54 are attached to the frame 14 by guide rod retainers 56 and 58. A pneumatic cylinder 60 is connected to the frame 14 and to the carriage 48 to move the carriage back and forth on the guide rods 54 toward or away from the driven spindles 18 and 20.

A dispenser 62 for a roll 63 of self-adhesive stretch film 64 includes a support rod 66 secured to the frame 14. Two arms 68 are pivotally and slidably supported by the support rod 66. A film roll support shaft 70 is attached to the free ends of the two arms 68. A roll 63 of self-adhesive stretch film 64 is supported by the film roll support shaft 70 between the two arms 68.

Various self-adhesive stretch films 64 could be used. One that has been found to be satisfactory is a linear low density polyethylene film manufactured by the Bemis Company of Oshkosh, Wis., and sold under the trademark THE BEMIS HANDLER. The film with stock number 918B9 is a 90 gauge film on eighteen inch wide rolls. U.S. Pat. Nos. 4,425,268 and 4,504,434 to Cooper, the disclosures of which are incorporated herein, are directed to the self-adhesive stretch film manufactured by the Bemis Company.

A bale support plate 72 is pivotally attached to the frame 14 of the machine 10. The bale support plate 72 pivots about a generally vertical axis. The bale support plate 72 is vertically adjustable to different positions. If desired, two bale support plates 72 may be employed. When two bale support plates 72 are employed, vertical adjustment may be eliminated.

The machine 10 for making an archery target 12 has a control system for controlling the pneumatic cylinder and for controlling the electric motor 32. The control system includes a control box 74, a switch for turning the electric motor 32 on and off, and a valve for directing air to and from the pneumatic cylinder 60. The switch and the valve are not shown in the drawing.

A banding tool, a bag holder, and a stencil 78 are required in addition to the machine 10 described above to make the archery target 12.

A rectangular agricultural bale of wheat straw 80 is used to make the archery target 12. Wheat straw works very well, is inexpensive, and is available in most areas of North America. Straw from other crops such as rye, rice, oats, barley, and flax could also be used, if desired. Rye and rice straw may work better than wheat straw, but they are generally more difficult to obtain. Other organic materials such as various types of hay could also be employed.

Rectangular agricultural hay balers make bales that have a width W of about 14 inches, a height H of about 18 inches, and a length L of about 44 inches. The height H and the width W are determined by the dimensions of the bale chamber. These dimensions are determined at the time of baler manufacture and are not adjustable. The length L is set by the needles in the baler twine tying mechanism. The needles encircle bales with two or more strands of twine 82 that is tied by a knotter and determines bale length L. The length L can be adjusted some by the operator of the baler. The baler operator adjusts the length of the bale by adjusting the linkage and cam mechanisms which engage the drive for the needles and the knotter. Most baler operators adjust their balers to produce bales that have a length L of about 44 inches.

The density of the bales 80 produced by agricultural balers depends upon the material being baled, the moisture content of the material being baled, and the adjustment of the hay baler. Operators of hay balers produce dry wheat straw bales with a density of between three and eight pounds per cubic foot. This density is too low to adequately control and limit arrow penetration. Arrow penetration of about 3 inches will hold an arrow in the same attitude the arrow had when it struck the target. Penetration of about 7 inches will not make arrow removal too difficult from a compressed straw target. Penetration of about 3 to 7 inches is, therefore, a good range.

Figure 2:
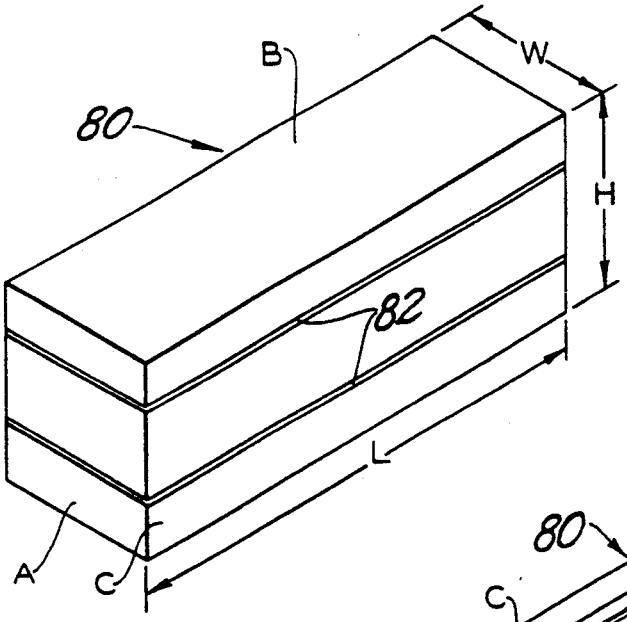
FIG. 2 is a perspective view of a straw bale produced by an agricultural type hay baler.
Figure 3:
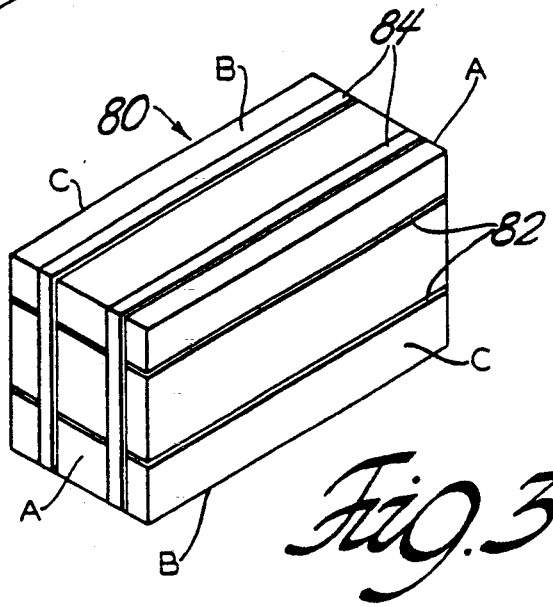
FIG. 3 is a perspective view of the straw bale in FIG. 2 after it has been reduced in length by further compaction of the straw and banded with two thin semi-rigid plastic bands.

The rectangular agricultural bale of wheat straw 80, as shown in FIG. 2, has two ends A, two small sides B, and two large sides C. The density of the bale of wheat straw 80 as produced by an agricultural baler is too low to limit arrow penetration to 7 inches. The density of a bale of wheat straw 80 needs to be increased by about thirty percent to limit penetration of a standard arrow with an aluminum shaft that is shot by a sixty-five pound bow at a distance of 20 yards to between 3 and 7 inches. Decreasing bale length L from about 44 inches to about 32 inches generally provides the correct density. If the bale of wheat straw 80 as produced by the hay baler is at the low end of the density range, it may be necessary to decrease the length L to less than 32 inches.

The archery target 12 is made by placing a bale of wheat straw 80 or a bale of some similar straw, hay or other organic material in the machine 10. The bale of wheat straw 80 is supported on side B on the bale support plate 72 with the support plate in an upper position. The pedestal 30 is turned about axis of shaft 42 so that the ends A of the bale of wheat straw 80 are facing the flat plate 26 and the flat plate 50. Air is directed to the cylinder 60 to move the flat plate 50 toward the flat plate 26. The flat plates 26 and 50 contact adjacent ends A of the bale of wheat straw 80 and reduce the length L to about 32 inches. This increases the density about thirty percent. The compressed length L can be increased or decreased as required to provide the desired density to control arrow penetration with different types of arrows and with different bows.

The bale support plate 72 is pivoted to one side and away from the bale of wheat straw 80. Two thin plastic retainer bands 84 are placed around the bale of wheat straw 80. The bands 84 are in contact with the ends A and the small sides B of compressed straw and do not pass over the flat plates 26 or 50. A banding tool is used to tighten the bands 84, secure the ends of the bands to each other, and to sever excess banding material from the ends of the bands. The original twine 82 that held the bale of wheat straw 80 together is loose after the plastic retainer bands 84 are secured around the bale of wheat straw 80. The twine 82 could be removed, if desired. However, the twine can be left in place because it will not damage or deflect arrows. Some agricultural bales are tied by wire, rather than by twine. The wire, which is on the large surfaces C of the bale, could damage an arrow and should be removed after the bale of wheat straw 80 is compressed between the flat plates 26 and 50.

Figure 4:
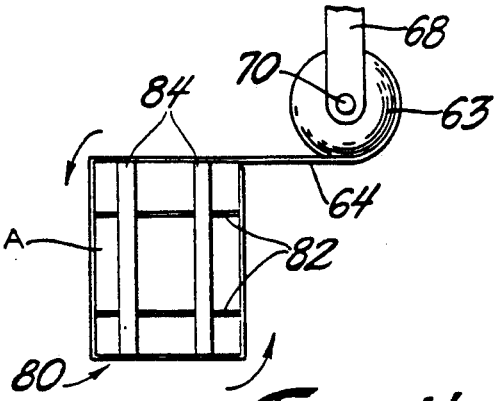
FIG. 4 is an end view of the compacted and banded straw bale while being wrapped with self-adhesive stretch film on four sides.

The electric motor 32 is turned on to drive the spindle 20, rotate the flat plate 26, rotate the bale of wheat straw 80 about an axis passing through the two ends A, rotate the flat plate 50, and rotate the spindle 46. The arms 68 of the dispenser 62 are slid along the support rod 66 to position the roll of self-adhesive stretch film 64 adjacent to one of the ends A of the bale of wheat straw 80. As the bale of wheat straw rotates as shown in FIG. 4, self-adhesive stretch film 64 is unwrapped from the film roll support shaft 70 and wrapped around the two small sides B and the two large sides C of the compressed bale of wheat straw 80 as shown in FIG. 4. After five complete wraps or more are applied, the arms 68 of the dispenser 62 are slid along the support rod 66 to position the roll of self-adhesive stretch film 64 adjacent to the other end A of the bale of wheat straw 80 without severing the self-adhesive stretch film and with the compressed bale continuing to rotate. As the compressed bale continues to rotate, self-adhesive stretch film 64 is again wrapped around the two small sides B and the two large sides C of the bale of wheat straw 80. Because the self-adhesive stretch film 64 is 18 inches wide, the sides B and C may be completely covered. After five or more wraps of self-adhesive stretch film have been applied adjacent to the other end A, the arms 68 of the dispenser 62 are slid along the support rod 66 to position the roll of self-adhesive stretch film 64 midway between the ends A. The electric motor 32 continues to run and five more wraps of self-adhesive stretch film 64 are wrapped around the two small sides B and the two large sides C of the bale of wheat straw 80 as shown in FIG. 4. The electric motor 32 is then turned off and the self-adhesive stretch film 64 is severed.

Figure 5:
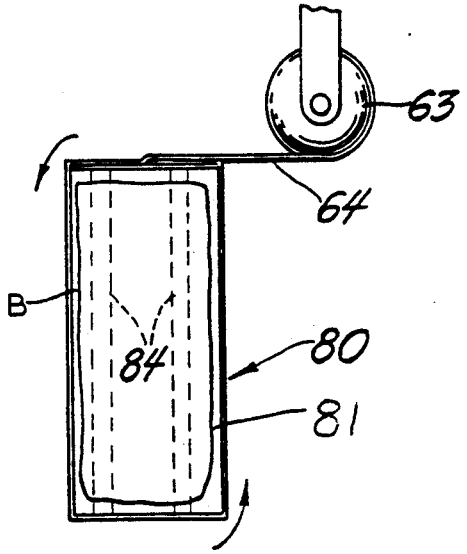
FIG. 5 is a side view of the compacted and banded straw bale while being wrapped with self-adhesive stretch film on the two largest sides and the ends.
Figure 6:
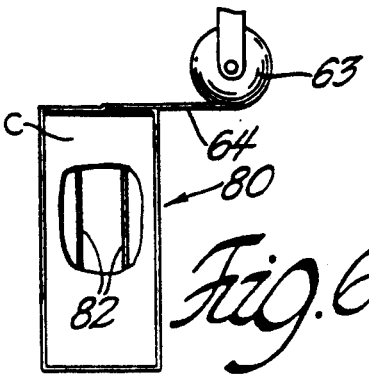
FIG. 6 is a reduced side view of the compacted and banded straw bale while being wrapped with self-adhesive stretch film on the two smallest sides and the ends with portions of the film broken away.

Following wrapping of the sides B and C of a bale of wheat straw 80 with multiple layers of self-adhesive stretch film 64, the bale is released from between the flat plates 26 and 50. The pedestal 30 is rotated 180 degrees about the axis of shaft 42 and the bale support plate 72 is lowered and pivoted back under the axis of the spindles 18, 20, and 46. The bale of wheat straw is placed on the bale support plate 72 with an end A in contact with the support plate. The cylinder 60 is pressurized to move the flat plate 50 toward one of the small sides B and hold the bale of wheat straw 80 between the flat plates 24 and 50. The bale support plate 72 is pivoted to one side and away from the bale of wheat straw 80. The electric motor 32 is turned on to drive the spindle 18, rotate the flat plate 24, rotate the bale of wheat straw 80 about an axis passing through the two small sides B, rotate the flat plate 50, and rotate the spindle 46. The arms 68 of the dispenser 62 are slid along the support rod 66 to position the roll of self-adhesive stretch film 64 adjacent to the ends A and the large sides C of the bale of wheat straw 80. The roll of self-adhesive stretch film 64 is first positioned so that it extends a short distance past one of the small sides B of the bale 80. Because the self-adhesive stretch film 64 is stretched as it is applied, the film on one end tends to wrap around the edges of the sides A and C and cover the edge of the small side B of the bale of wheat straw 80 as shown at 81 in FIG. 5. After five wraps are applied, the arms 68 of the dispenser 62 are slid along the support rod 66 until the self-adhesive stretch film 64 extends a short distance past the other small side B of the bale. After five more wraps with the self-adhesive stretch film 64 covering the edges of the other small side B, the arms 68 of the dispenser 62 are slid along the support rod 66 until the self-adhesive stretch film 64 is centered between the two small sides B and five centered wraps are applied. After fifteen complete wraps are applied to ends A and sides C as shown in FIG. 6 and described above, the electric motor 32 is shut off. The self-adhesive stretch film 64 may be severed or may remain attached.

The bale support plate 72 is pivoted back under the compressed bale of wheat straw 80, the cylinder 60 retracts the flat plate 50, and the spindle 46 and the bale is rotated 90 degrees on the support plate 72 about an axis through the ends A of the compressed bale. The self-adhesive stretch film 64 is twisted if it has not been severed. The cylinder 60 then advances the flat plate 50 toward one of the large sides C of the compressed bale of wheat straw 80 until the bale is held between the flat plates 24 and 50. The bale support plate 72 is then pivoted to one side and away from the bale of wheat straw 80 and the electric motor 32 is turned on. The arms 68 of the dispenser 62 are slid along the support rod 66 to position the roll of self-adhesive stretch film 64 adjacent to the ends A and the small sides B of the bale of wheat straw. As the motor 32 rotates the bale of wheat straw 80 about an axis through the large sides C, self-adhesive stretch film 6 is unwrapped from the film roll 63 support shaft 70 and wrapped around the ends A and the small sides B. After about fifteen complete wraps are applied as shown in FIG. 6, the electric motor 32 is turned off, the self-adhesive stretch film 64 is severed and the bale of wheat straw 80 is removed from the machine 10. The self-adhesive stretch film 64 is normally applied to the ends A and the small sides B with five wraps to one side, five wraps to the other side and five wraps in the center. This results in edges of the self-adhesive stretch film 64 wrapping around the corners and into contact with the large sides C.

The self-adhesive stretch film 64 further compresses the bale of wheat straw 80 and could retain the compressed straw without the thin plastic bands 84. The thin plastic bands 84 could be removed if desired. The thin plastic bands 84 do not contact the target surfaces C and do not, therefore, have to be removed. The thin plastic bands 84 are left under the multiple wraps of self-adhesive stretch film 64.

Figure 7:
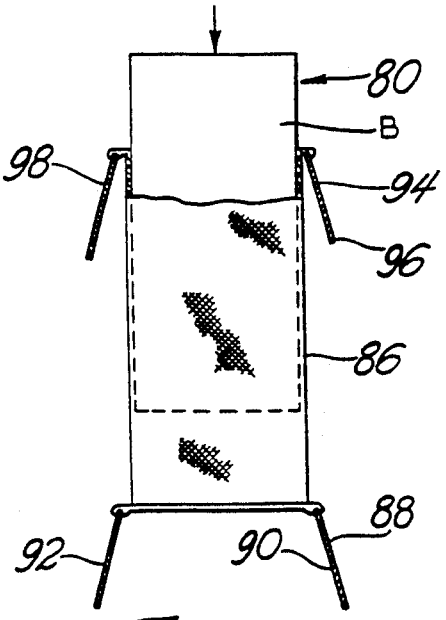
FIG. 7 is a schematic view of the compacted, banded, and wrapped bale being inserted into a burlap bag with portions of the bag broken away.

The bale of wheat straw 80, that has been compressed and wrapped with self-adhesive stretch film 64 is inserted into a bag 86 made of burlap as shown in FIG. 7. The bag 86 as shown has two open ends. A rope 88 with ends 90 and 92 is inserted into a sleeve in the bottom end of the bag 86. A rope 94 with ends 96 and 98 is inserted into a sleeve in the top end of the bag 86. After the wrapped bale of wheat straw is inserted into the bag 86 made of burlap, the ropes 88 and 94 are tightened and tied to close both open ends of the bag and retain the compressed bale of wheat straw 80 in the bag. After the ends of the bag 86 are closed, the rope 88 is tied to the rope 94 to form a handle for carrying the archery target 12.

Figure 8:
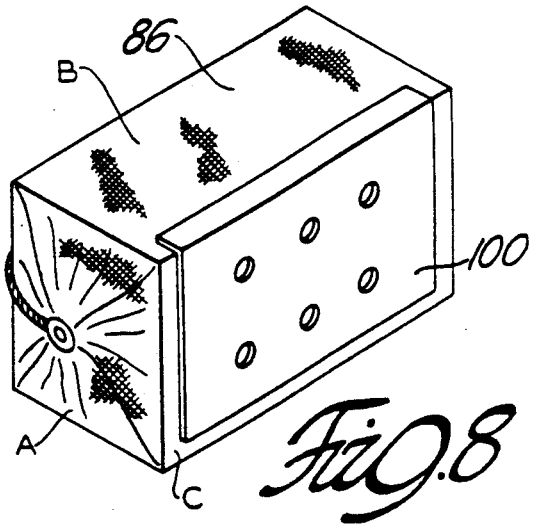
FIG. 8 is a perspective view of the archery target with a stencil on one side for marking targets on the burlap.
Figure 9:
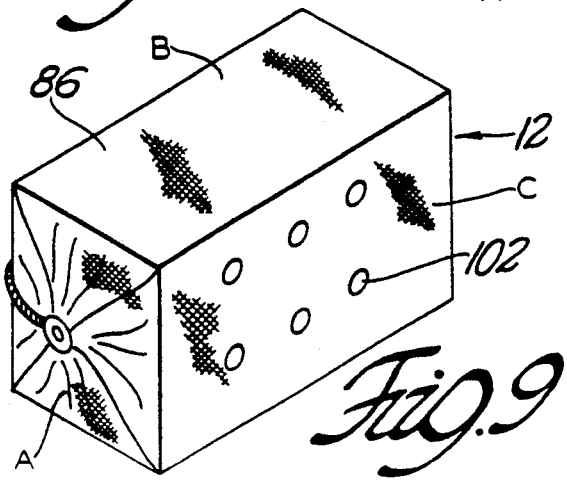
FIG. 9 is a perspective view of the completed archery target laying on its side.

The compressed and wrapped bale of wheat straw 80 fits snugly into the burlap bag 86. It is, therefore, desirable to employ a bagging stand which holds one end of the bag 86 while the wrapped bale of wheat straw 80 is forced into the bag. After the compressed and wrapped bale of wheat straw 80 is inserted into the bag 86 and the bag is closed by ropes 88 and 94. A stencil 100 is positioned against sides of the bag 86 that cover the large sides C of the compressed and wrapped bale of wheat straw 80. Paint or ink are then sprayed onto the burlap bag 86 through the stencil 100 to affix target indicia 102 to the bag 86. Both of the large sides C of the bag 86 are marked so that the archery target 12 is reversible. As shown in FIG. 8, the target indicia 102 is six round dots. Target indicia 102 with other shapes can be used if desired.

The self-adhesive stretch film 64 is a puncture resistant, heavy-duty 90 mil film in rolls that are eighteen inches wide. Films with other widths and thicknesses could be used. The self-adhesive stretch film 64 provides minimal resistance to the passage of a sharp arrow. As an arrow is removed, the multiple layers of self-adhesive stretch film 64 wipe the arrow shaft and, at least partially, close the hole made by the arrow. Straw is retained inside the archery target 12 and the density of the target remains essentially unchanged. This allows the target to accommodate many arrow punctures and still have the ability to stop and hold additional arrows.

Multiple layers of self-adhesive stretch film 64 are used. The number of layers varies depending upon the thickness of the film and the organic material in the bale. If thicker self-adhesive stretch film 64 is used, fewer wraps may be required. If the organic material is coarser than wheat straw, it may be necessary to add additional wraps to prevent punctures of the self-adhesive stretch film by the organic material in the compressed bale 80. As described above, the center of the large sides C that are pierced by arrows have a minimum of 30 layers of self-adhesive stretch film 64. Forty layers of self-adhesive stretch film 64 have been found to work well. If too many layers of stretch film are applied, arrow removal becomes difficult. The last wraps of self-adhesive stretch film 64 are applied to the ends A and the two small sides B which are not target faces. These layers of self-adhesive film 64 tend to hold the other layers in place on the large sides C, retain material in the bale 80 and thereby extend the life of the target 12.

It is to be understood that the embodiments described are exemplary of various forms of the invention only and that the invention is defined in the appended claims which contemplate various modifications within the spirit and scope of the invention.

We claim:

1. An archery target including a rectangular bale of compressed organic material, a multi-layer wrap of film covering target surfaces of the bale that retains organic material in the rectangular bale when arrows are withdrawn, a cover of woven material covering the rectangular bale and the multi-layer wrap of film, and target indicia on the woven material.

2. The archery target of claim 1 wherein the density of the compressed organic material allows arrow penetration within a predetermined range.

3. The archery target of claim 2 wherein the predetermined range of arrow penetration is three to seven inches.

4. The archery target of claim i wherein the film is a self-adhesive stretch film.

5. The archery target of claim 4 wherein the film is water impervious.

6. The archery target of claim 4 wherein all six surfaces of the rectangular bale of compressed organic material are covered by the multi-layer wrap of film.

7. The archery target of claim 6 wherein the surfaces without target indicia are wrapped by film after the surfaces with target indicia are wrapped.

8. The archery target of claim 1 wherein the cover of woven material has ends that are closed to retain the rectangular bale by ropes and two of the ropes are tied together to form a carrying strap.

9. The archery target of claim 1 wherein the organic material is wheat straw.

10. A method of making an archery target from a rectangular bale of organic material with two end walls and four side walls including compressing the rectangular bale to increase the density of the organic material and to reduce the length of the bale, applying one or more bands to retain the compressed rectangular bale, wrapping the four side surfaces of the rectangular bale with multiple layers of a film, inserting the compressed and wrapped rectangular bale in a woven bag, and applying target indicia to at least one surface of the woven bag.

11. The method of making an archery target set forth in claim 10 wherein all six sides of the compressed rectangular bale are wrapped with multiple layers of a film.

12. The method of making an archery target of claim 10 wherein the film that wraps the compressed rectangular bale is self-adhesive stretch film.

13. The method of making an archery target of claim 11 wherein target indicia are applied to the woven bag adjacent two opposite sides of compressed rectangular bale and wherein the four sides of the compressed rectangular bale are wrapped with film first, the two ends and the two sides adjacent to the target indicia are wrapped with film next, and the two ends and the two sides of the compressed rectangular bale that are not adjacent to the target indicia are wrapped with film after the ends and the two sides adjacent to target indicia are wrapped.

14. The method of making an archery target of claim 13 wherein the film that wraps the rectangular bale is self-adhesive stretch film.

15. The method of making an archery target of claim 10 wherein the rectangular bale is compressed straw.

16. The method of making an archery target of claim 15 wherein the straw is wheat straw.

17. The method of making an archery target of claim 10 wherein target indicia are applied to surfaces of the woven bag by placing a stencil against the surfaces and then applying paint to portions of the woven bag that are not covered by the stencil.

* * * * *